340-567 SR
8/17/82 XR 4,345,167

United States Patent [19]

Calvin

[11] 4,345,167

[45] Aug. 17, 1982

[54] CAPACITANCE PROXIMITY SENSOR

[76] Inventor: Noel M. Calvin, 2683 Buena Vista, Berkeley, Calif. 94708

[21] Appl. No.: 113,867

[22] Filed: Jan. 18, 1980

Related U.S. Application Data

[63] Continuation-in-part of Ser. No. 924,499, Jul. 14, 1978, abandoned.

[51] Int. Cl.[3] ..... G08B 13/26

[52] U.S. Cl. ..... 307/308; 307/246; 324/61 R; 328/5; 340/562; 340/567

[58] Field of Search ..... 307/246, 308, 99; 324/61 R, 61 P; 328/5; 340/530, 562, 567, 561

[56] References Cited

U.S. PATENT DOCUMENTS 4,004,234 1/1977 Juvinall ..... 307/308 X
4,081,700 3/1978 Hamilton ..... 328/5 X

FOREIGN PATENT DOCUMENTS 1099854 1/1968 United Kingdom ..... 328/5

*Primary Examiner*—John Zazworsky
*Attorney, Agent, or Firm*—Herzig & Walsh, Inc.

[57] ABSTRACT

A method for detecting the change in the capacitance of an antenna caused by the approach of a person to the antenna, including the step of charging said antenna to a predetermined voltage relative to ground or a reference antenna, the step of discharging the antenna through a capacitor such that the voltage developed across the capacitor is proportional to the initial charge on the antenna, said charging and discharging steps being sequentially repeated, and the step of comparing the instantaneous voltage across the capacitor to the long term average voltage to detect transient changes caused by an increase in the antenna capacitance resulting from the approach of a person.

12 Claims, 7 Drawing Figures

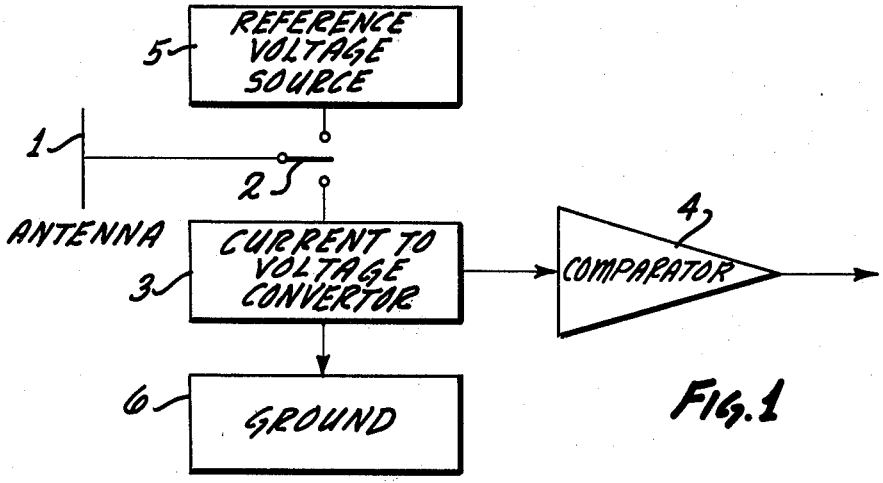
FIG. 1
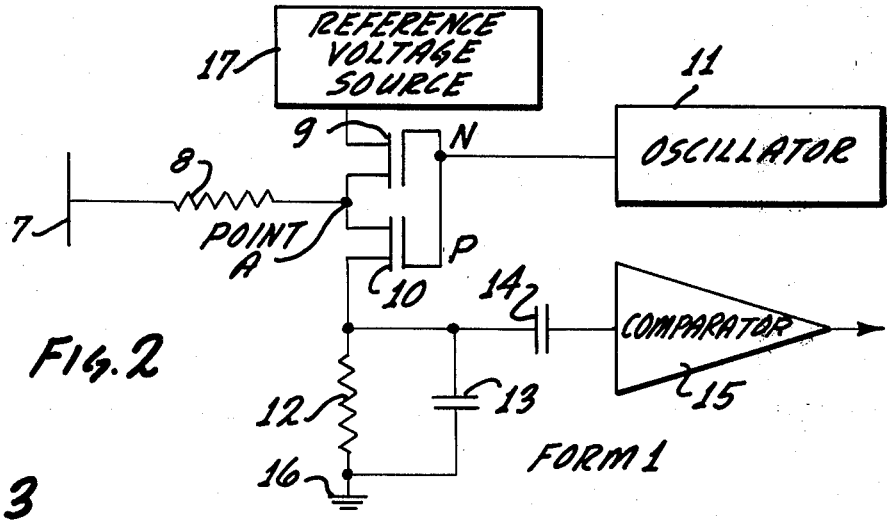
FIG. 2
FIG. 3
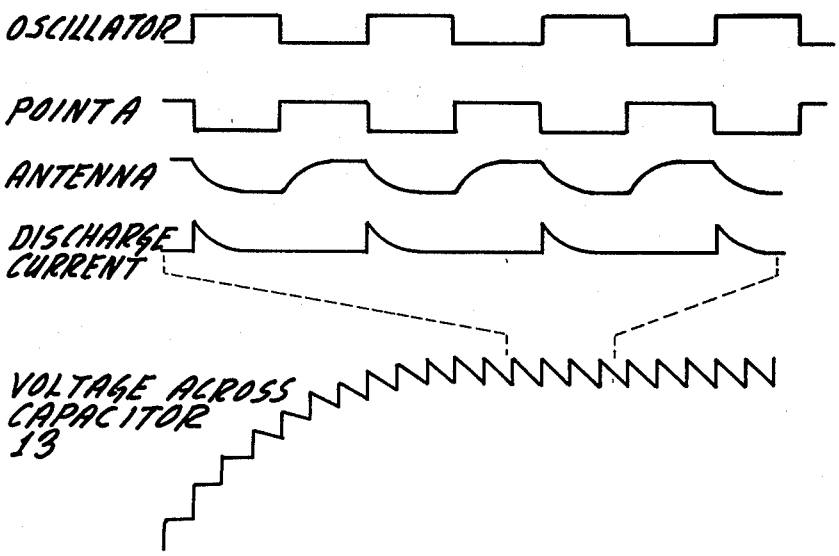

FORM 2

FORM 3

CAPACITANCE PROXIMITY SENSOR

This application is a continuation-in-part of application Ser. No. 924,499, filed July 14, 1978, now abandoned.

BACKGROUND AND PRIOR ART

Every conductive object possesses a characteristic capacitive coupling to every other conductive object and the ground plane of the earth, the magnitude of that coupling being a function of the object's size and its proximity to other conductive objects. The capacitive coupling between two metal antennas, or between a single antenna and the ground plane, will be increased by the nearby presence of a human body, which by virtue of the salts dissolved in the intercellular and extracellular fluids will behave as a conductor.

This elementary fact has been known for many decades, and has served as the basis for the design of a great variety of electronic devices which can detect the approach of a person to a metal antenna by sensing the increase in the capacitance of the antenna that the person produces. These devices are generically known as capacitance proximity sensors, and can be divided into classes on the basis of the method employed to measure the capacitance of the antenna.

Most of the existing devices employ one of two basic methods, which I will refer to as the resonance conversion method and the reactance conversion method.

In the resonance conversion method the capacitance of the antenna is converted into a frequency by utilizing the antenna as the capacitive element in an inductance-capacitance oscillator. The frequency of oscillation will be proportional to the inverse square root of the antenna capacitance, and a change in capacitance caused by the approach of a person will be reflected in a change in frequency. Any of many standard methods can be employed to monitor the oscillator frequency and provide an indication when the frequency deviates beyond some preset amount.

In the reactance conversion method the capacitance of the antenna is converted into a voltage. The antenna is driven by a high impedance signal source, and the signal at the antenna is rectified and filtered. The capacitive reactance of the antenna will load the signal source, and the signal amplitude will be inversely proportional to the antenna capacitance, the signal frequency, and the signal source impedance. An increase in antenna capacitance caused by the approach of a person will thus be reflected in a reduction in signal level, and hence in the output voltage of the rectifier.

While both these methods work very well on a laboratory bench, their practical application has been limited by a necessary compromise between sensitivity and noise resistance. Transients with an amplitude of several hundred to several thousand volts are routinely found on residential power lines, and these transients are fed into the proximity sensor by capacitive coupling between the sensor antenna and the power lines. Transients of sufficient amplitude can cause momentary alterations in both the frequency of a resonance convertor and the apparent reactance of the antenna, so in order to prevent an erroneous response to electrical noise a limit must be placed on the sensitivity of the proximity sensor.

With most sensor designs this limit is so low that the sensor is useless for practical purposes, and while some successful attempts have been made to reduce susceptibility to noise without sacrificing sensitivity, they have so far led to designs too complex—and therefore expensive—to be economically practical.

SUMMARY AND OBJECTS OF THE INVENTION

The invention relates to a method for detecting the change in the characteristic capacitance of a metal antenna that results from the approach of a person to the antenna. The basic principle of operation of the invention derives from the fact that the amount of charge stored in a capacitor is directly proportional to the size of the capacitor and the voltage to which it is charged. If a capacitor is repetitively charged to a fixed voltage and then discharged the average discharge current will be proportional to the value of the capacitor. Any change in the value of the capacitor will be reflected in a change in the average discharge current.

In the invention the principle is applied such that the sensor antenna is repetitively charged to a fixed voltage relative either to the ground plane of the earth or to a reference antenna and discharged through a discharge resistor and an averaging capacitor connected in parallel. The voltage developed across the resistor is proportional to the average discharge current, and hence the capacitance of the antenna.

An increase in the antenna capacitance due to the approach of a person will result in a larger discharge current, and therefore an increase in the voltage developed across the resistor. This voltage is AC coupled to a comparator, which changes state when the increase in voltage exceeds a preset level, thus providing an indication that an approach has been detected.

The unique advantage of this method is that it is extremely resistant to electrical noise. When the antenna is being charged transients are shorted out through the power supply, and during discharge they are shorted through the averaging capacitor.

In order to accommodate a range of antenna sizes without the need for individual adjustment of the discharge resistor, the resistor can be replaced with an active current sink which automatically sinks whatever current is necessary to keep the voltage across it at the same average level.

The primary object of the invention is to detect the change in capacitance of a sensor antenna that results from the approach of a person to the antenna.

A further object of the invention is to achieve a very high resistance to electrical noise so that very small changes in antenna capacitance can be detected without erroneous triggerings due to noise.

A further object of the invention is to adjust automatically to a wide range of antenna sizes.

DESCRIPTION OF THE DRAWINGS

FIG. 1 is a block diagram of the invention.

FIG. 2 is a schematic diagram of form 1 of the invention.

FIG. 3 is a drawing showing the waveforms associated with form 1 of the invention.

DETAILED DESCRIPTION OF THE PREFERRED EMBODIMENTS

Figure 4:
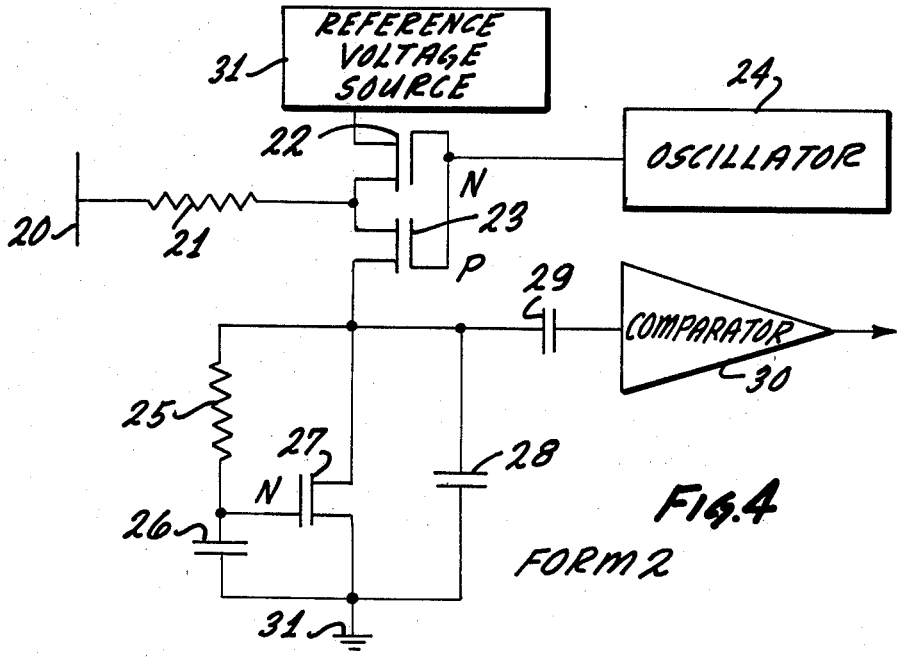
FIG. 4 is a schematic diagram of form 2 of the invention.

The invention relates to a method for measuring the capacitance of a sensor antenna, and for responding to changes in said capacitance caused by the approach of a person or object to the antenna. The method involves repetitively charging the sensor antenna to a reference voltage and then discharging it such that a voltage proportional to the amount of charge on the antenna is generated. Changes in the capacitance of the antenna are detected by a suitable voltage comparator.

A block diagram of the invention is shown in FIG. 1. It is comprised of a sensor antenna 1, a SPDT electronic switch 2, a current to voltage convertor 3, a comparator 4, a reference voltage source 5 and a ground connection 6.

The electronic switch oscillates between the reference voltage source and the current to voltage convertor such that the antenna is first charged to the reference voltage and then discharged to ground through the convertor. Every time the antenna is discharged a current pulse will flow through the convertor, the magnitude of which is proportional to the capacitance of the antenna and the reference voltage. The convertor generates a voltage that is proportional to the average magnitude of the current pulses. The approach of a person to the antenna will increase the capacitance of the antenna, which causes the magnitude of the current pulses to increase. This results in an increase in the output voltage of the converter, which is detected by the comparator. The comparator responds by producing an output signal that can be used to activate any external circuitry, such as alarms or light switches.

In order to illustrate some of the ways in which the concept of the invention can be embodied, detailed descriptions of four different forms of the preferred embodiment have been included in this disclosure, hereafter designated form 1, form 2 and form 3.

The differences between these three forms of the preferred embodiment lie in the nature of the circuitry employed to implement the function of the current to voltage convertor, and in whether the circuit ground is connected to the ground plane of the earth or is connected to a reference antenna instead, allowing the entire capacitance proximity sensor to float with respect to the ground plane of the earth.

A schematic diagram of form 1 of the preferred embodiment is shown in FIG. 2. Antenna 7 may be any size from a short length of wire to a very large truck, and may be composed of any conductive material, including living plants and the like. Resistor 8 limits the maximum current that can flow from the antenna to the circuitry, protecting the sensor from damage by large electrical transients that might be coupled to the antenna from power lines. Transistors 9 and 10 are, respectively, N- and P-channel enhancement mode MOSFET transistors with a gate-source threshold of approximately 1.5 volts. The transistors are connected as a SPDT electronic switch precisely analogous to switch 2 in FIG. 1. The transistors are connected to oscillator 11, whose output is a square wave with an amplitude sufficient to turn transistor 10 completely off and transistor 9 completely on when it is low, and to turn transistor 10 completely on and transistor 9 completely off when it is high. Resistor 12 and capacitor 13 form a passive current to voltage convertor/averager, and capacitor 14 AC couples the output of the convertor circuit to comparator 15, which may be any voltage comparator with a preset positive threshold.

Form 1 of the preferred embodiment operates as follows:

When the output of the oscillator is low, transistor 10 is turned off and transistor 9 is turned on, allowing the antenna to charge to the reference voltage through resistor 8. When the output of the oscillator goes high, transistor 9 turns off and transistor 10 turns on, transferring the charge on the antenna to capacitor 13 through resistor 8. This causes the voltage on capacitor 13 to rise slightly. Each time a charge-discharge cycle is completed—i.e., every cycle of the oscillator—the voltage on capacitor 13 rises higher, until the current through resistor 12 exactly equals the average discharge current. At this point the voltage across capacitor 13 will remain constant except for a sawtooth ripple, the magnitude of which will be determined by the discharge current and the size of the capacitor.

When a person or object approaches the antenna, the capacitance of the antenna will increase, causing the discharge current to rise. This in turn results in an increase in the voltage on capacitor 13. This increase is coupled to the comparator through capacitor 14, and if it is larger than the preset threshold of the comparator, the comparator will change state, indicating the detection of an approach.

The waveforms associated with the operation of form 1 of the preferred embodiment are shown in FIG. 3. The voltage across capacitor 13 is shown as it rises to equilibrium, with the ripple exaggerated for the purposes of illustration. The waveforms of the discharge current and antenna voltage for four cycles are shown on an expanded scale in the upper section of the figure.

The use of a passive current to voltage convertor/averager, as shown in FIG. 2, places several constraints on the sensitivity and versatility of the proximity sensor. The voltage across capacitor 13 is proportional to the average antenna discharge current, which is in turn proportional to the reference voltage, the antenna capacitance, and the oscillator frequency. The relationship is given by the following equation:

$$E=RCF/1+CF\times r\times K$$

where

E = voltage across capacitor 13
R = reference voltage
C = capacitance of the antenna
F = oscillator frequency
r = resistor 12
K = proportionality constant Assuming the oscillator frequency and the reference voltage to be 1, and for the purposes of simplification assuming r to be equal to 1/K, the equation can be reduced to:

$$E=C/1+C$$

The sensitivity, S, can be defined as the change in E that results from a given percentage change in C, or:

$$S=\frac{dE}{dC/C}=\frac{dE}{dC}C$$

-continued $$\frac{dE}{dC} = (1 - E)^2$$

Therefore, $$S = (1 - E)^2 \frac{E}{1 - E} = E - E^2$$

$$\frac{dS}{dE} = 1 - 2E$$

It will be seen that S reaches a maximum when E=0.5, or, where R is not equal to 1, the maximum sensitivity will be reached when $E=\frac{1}{2}R$. At this value, the sensitivity will be:

$$S = \tfrac{1}{4}, \text{ or, where } R \neq 1,$$

$$S = \tfrac{1}{4}R$$

For example, a 10% change in antenna capacitance with a reference voltage of 10 will result in a change in E of:

$$\Delta E = \Delta C/C \times S \times R = 0.1 \times \tfrac{1}{4} \times 10 = 250\ mv$$

In order to achieve maximum sensitivity with antennas of different sizes it is necessary to adjust either r or F until $E=\frac{1}{2}R$. This requires a manual adjustment after the sensor has been connected to the antenna, which makes the sensor more expensive if it is performed during manufacture, or difficult to use if it is done at the time of installation. In order to avoid the need for this adjustment, the passive current to voltage convertor can be replaced with an active one, which adjusts automatically to any size antenna while maintaining sensitivity.

A schematic diagram of form 2 of the invention incorporating an active current to voltage convertor is shown in FIG. 4. Antenna 20, resistor 21, transistors 22 and 23, oscillator 24, capacitor 29 and comparator 30 all function in exactly the same manner as the corresponding components in form 1, as shown in FIG. 2.

The active current to voltage convertor is formed by transistor 27, which is an N-channel enchancement mode MOSFET transistor identical to transistor 10 in FIG. 2 and transistor 23 in FIG. 4, a low pass filter made by resistor 25 and capacitor 26 together, and ripple capacitor 28.

When the circuit is first turned on capacitor 26 is discharged and transistor 27 is off. Capacitor 28 begins to charge due to the antenna discharge current and capacitor 26 charges through resistor 25. When the voltage across capacitor 26 reaches the gate-source threshold voltage of transistor 27, the transistor begins to conduct. As the voltage continues to rise transistor 27 conducts more heavily, behaving essentially as a voltage controlled resistor, until the current flowing through it exactly balances the discharge current from the antenna, at which point equilibrium is attained. The voltage, E, at which equilibrium is established is determined by the conduction threshold of the transistor, and the transistor should be chosen such that $E \cong \frac{1}{2}R$. If the transistor has high transconductance then the convertor will be able to accommodate a wide variety of antenna sizes while maintaining a nearly ideal sensitivity.

Resistor 25 should be chosen such that it produces negligible loading, and the time constant of resistor 25 and capacitor 26 should be long as compared to the time it takes a person or object to approach the antenna.

Because MOSFET transistor 27 behaves as a voltage controlled resistor, the sensitivity of the sensor can be no higher than the ideal sensitivity predicted for the first form of the invention, using a passive current to voltage convertor. A modest improvement in sensitivity can be realized by the addition of a bipolar transistor to modify the active current to voltage convertor, as shown in the third form of the preferred embodiment.

Figure 5:
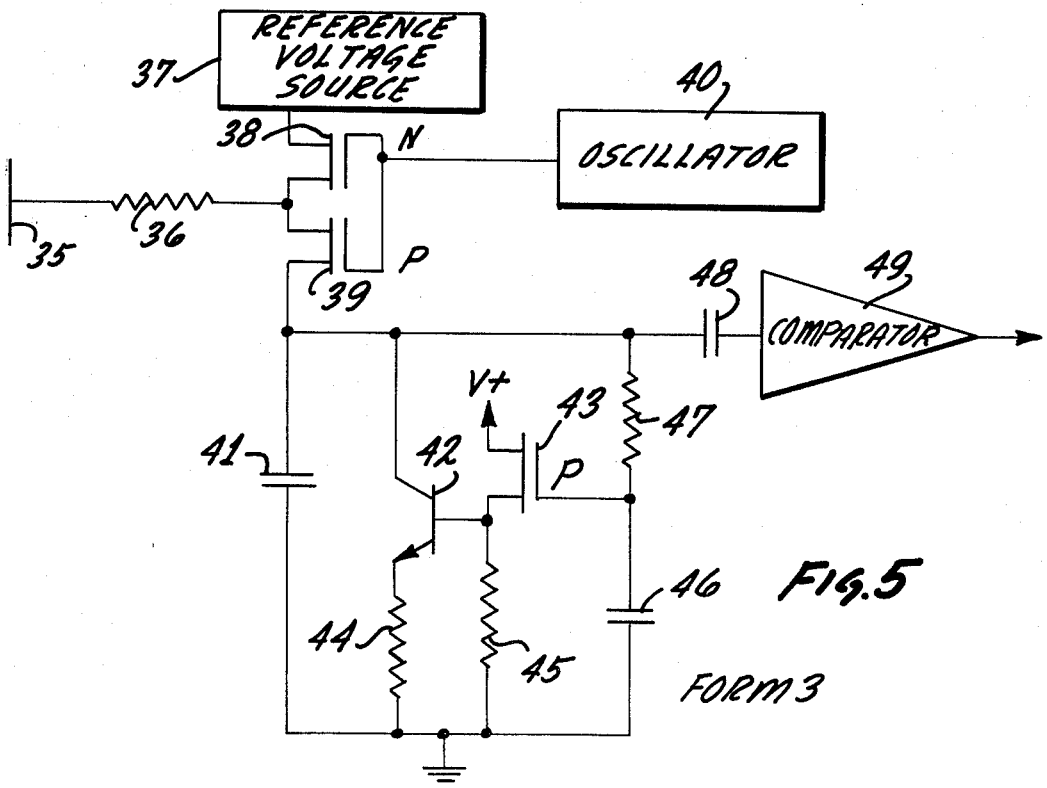
FIG. 5 is a schematic diagram of form 3 of the invention.

A schematic diagram of the third form of the embodiment is shown in FIG. 5. Antenna 35, resistor 36, reference voltage source 37, transistors 38 and 39, oscillator 40, capacitor 48 and comparator 49 all function in precisely the same manner as their analogs in both previous embodiments. The modified active current to voltage convertor is composed of an NPN bipolar transistor 42, a P-channel enhancement mode MOSFET transistor 43, a low pass filter made by resistor 47 and capacitor 46, and ripple capacitor 41.

When the sensor is turned on, capacitor 41 begins to charge by the antenna discharge current, and capacitor 46 begins to charge through resistor 47. When the voltage on capacitor 46 exceeds the gate-source conduction threshold of transistor 43, the transistor, which functions as a source follower, turns on, developing a voltage across source resistor 45. When the voltage across resistor 45 exceeds 0.6 volts, transistor 42 begins to conduct, functioning as a current sink. When the current flowing through transistor 42 equals the antenna discharge current, equilibrium is achieved. The time constant of resistor 47 and capacitor 46 should be long as compared with the time required for an object or person to approach the antenna. Resistors 44 and 45 function as loading resistors and reduce the contribution of junction noise from both transistors to the output voltage of the convertor.

If resistor 47 and the input impedance of comparator 49 are very large, the sensitivity of the detector is determined solely by the relative magnitudes of the reference voltage and the voltage across capacitor 41, according to the following equation:

$$S = \Delta E/\Delta C/C = R\text{-}E$$

where

R=reference voltage

E=voltage across capacitor 41

The maximum sensitivity of the modified active convertor therefore approaches R when $R >> E$. This is 4 times the maximum sensitivity for either the passive or active detector circuits. In practice, however, R is limited to 15 volts by the voltage limits of the MOSFET transistors, and E is usually about 3 volts due to the conduction threshold of transistor 43. The maximum sensitivity is therefore about 12, as compared with 3.75 for a passive convertor using a 15-volt reference voltage, an increase of about 3 times in sensitivity.

A much larger increase in sensitivity can be realized by isolating the current to voltage convertor from the antenna using a current mirror. The schematic of the fourth form of the preferred embodiment, incorporating a current mirror and a modified active current to voltage convertor is shown in FIG. 6.

Figure 6:
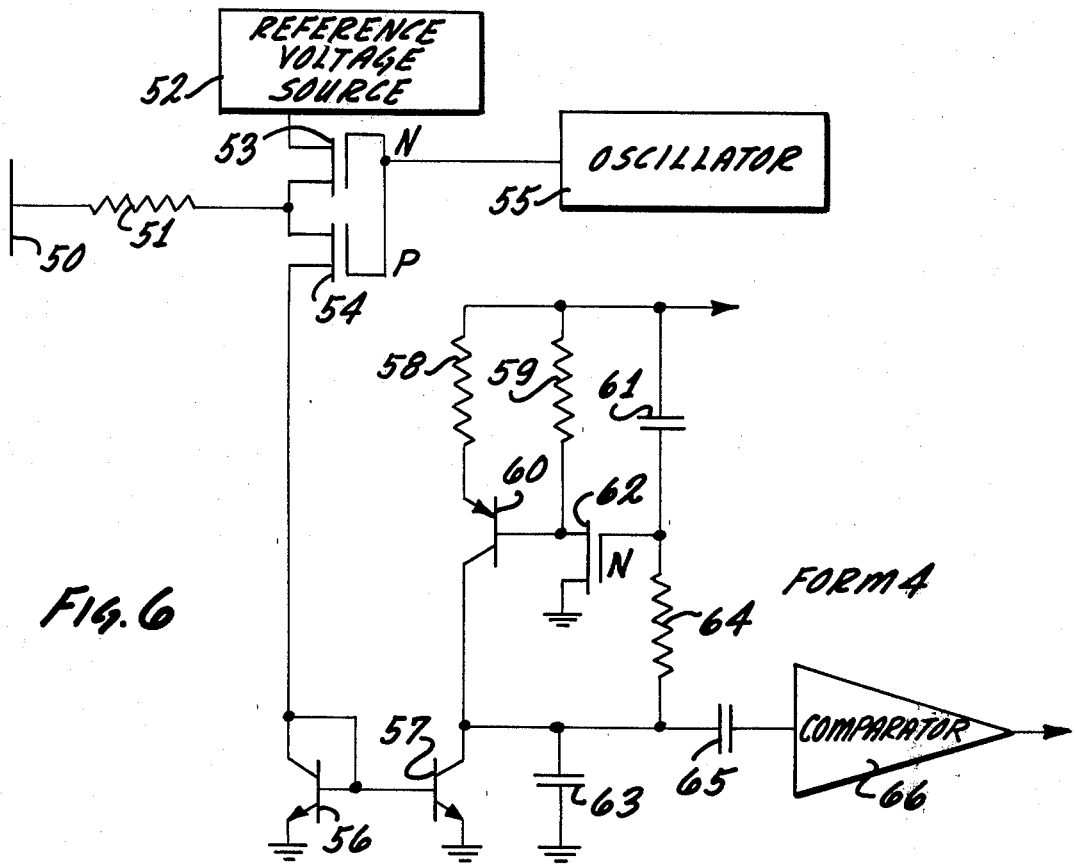
FIG. 6 is a schematic diagram of form 4 of the invention.

In FIG. 6 antenna 50, resistor 51, reference voltage source 52, MOSFET transistors 53 and 54, oscillator 55, coupling capacitor 65 and comparator 66 all function in exactly the same manner as their counterparts in forms 1, 2 and 3.

Transistors 56 and 57 are bipolar NPN types, connected as a current mirror. For the lowest thermal noise the transistors should be matched, and ideally would be mounted on the same substrate. PNP transistor 60 and N-channel enhancement mode MOSFET transistor 62 are connected to function as a modified active current to voltage convertor, identical to that used in form 3 (FIG. 5) except that the convertor is referenced to the positive power supply rather than ground.

The current mirror functions such that any current that flows through the collector of transistor 56 must also flow through the collector of transistor 57. Thus, every time the antenna is discharged through transistor 56, a current pulse of identical magnitude is drawn through transistor 57, which discharges capacitor 63. As capacitor 63 discharges, capacitor 61 discharges through resistor 64. When the voltage across capacitor 61 exceeds the gate-source threshold of transistor 62, the transistor turns on, increasing the voltage across load resistor 59 until transistor 60 begins to conduct. Equilibrium is attained when the current flowing through transistor 60 exactly equals the average antenna discharge current flowing through both transistors 54 and 56. Capacitor 63 is chosen to keep ripple to an acceptable level, and the time constant of resistor 64 and capacitor 61 is chosen to be long as compared to the time required for an approach to be made to the sensor.

When an approach is made to the sensor antenna its capacitance increases, increasing the magnitude of the discharge current. This causes capacitor 63 to discharge. If transistors 57 and 60 functioned as perfect current sinks and sources, the voltage across capacitor 63 would continue to decrease until the additional current flowing through resistor 64 exactly balanced the increase in discharge current. In practice, however, bipolar transistors do not function as perfect current sinks, and the magnitude of the voltage change across capacitor 63 will be determined by the output resistance of transistor 57. The output resistance of the transistor, or as it is more usually expressed, the conductance ($h_{22}$) is a function of the collector current and the specific type of transistor. The sensitivity is given by:

$$S=\Delta E/\Delta C/C=I\,R_c$$

where

E=voltage across capacitor 63

C=antenna capacitor

I=average discharge current $R_c$=output resistance of transistor 57

In order to maximize sensitivity, both I and $R_c$ should be made as large as possible. In practice the internal resistance of transistor 54 at saturation limits I to 1 ma, and the maximum $R_c$ is about 100 KΩ, yielding a sensitivity of about 100.

All four of the forms of the invention described thus far employ a connection to the ground plane of the earth. However, under certain circumstances such a connection may be impossible, as when the sensor is to be operated from batteries in a portable form. In this case the ground connection may be replaced with a second antenna, referred to as the reference antenna. In this case the sensor circuitry measures the capacitive coupling between the reference antenna and the sensor antenna, rather than the capacitance of the sensor antenna relative to ground, and responds to the increase in coupling between the two antennas that results from the approach of a person. The two antennas need not be of similar size or shape, although maximum sensitivity will be achieved when they are. The batteries themselves often provide a sufficient reference antenna for portable sensors.

Figure 7:
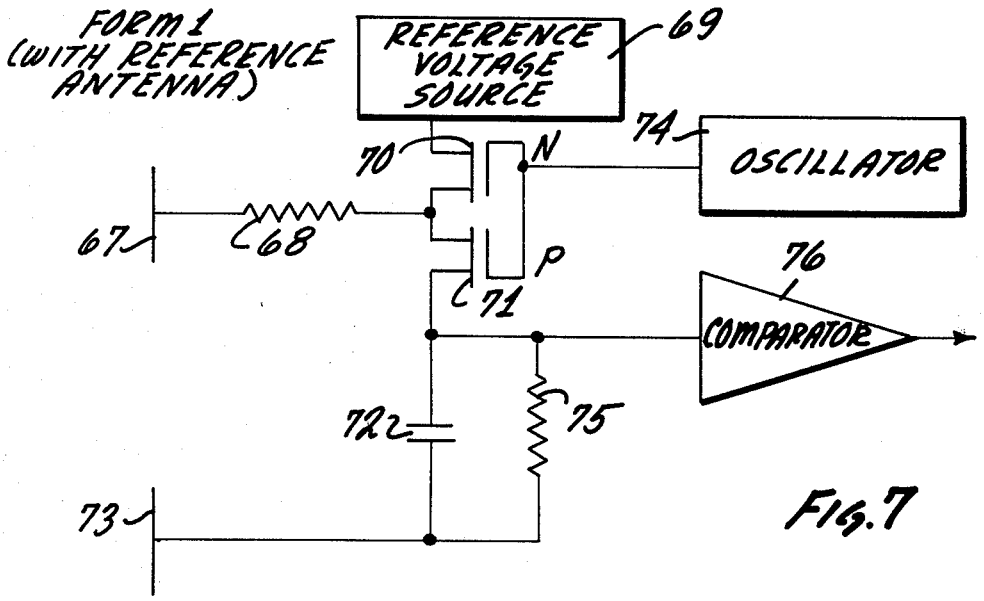
FIG. 7 is a schematic diagram of form 1 of the invention showing a connection to a reference antenna instead of an earth ground.

A schematic diagram of form 1 of the invention employing a reference antenna is shown in FIG. 7. All components of the sensor circuitry are identical with those shown in FIG. 2, except that the ground connection 16 shown in FIG. 2 has been replaced with reference antenna 73. The three other forms of the invention may be adapted for use with a reference antenna in a precisely analagous manner.

From the foregoing, those skilled in the state of the art will readily understand the nature of the invention, the manner in which the method is executed, and the manner in which all the objects set forth are achieved and realized.

The foregoing disclosure is representative of the preferred forms of the invention and is to be interpreted in an illustrative rather than a limiting sense, the invention to be accorded the full scope of the claims appended hereto.

I claim:

1. A method for detecting changes in the capacitance of an antenna caused by the approach of a person or object to the antenna comprising in combination the steps of:

charging said antenna to a fixed voltage relative to a reference body; discharging said antenna through a current to voltage convertor such that the output voltage of the convertor is proportional to the amount of charge stored on the antenna, performing said charging and discharging steps repetitively and in sequence; and monitoring said output voltage to detect changes caused by the approach of a person or object to the antenna, which will increase the capacitance of the antenna, and hence increase the amount of stored charge.

2. An apparatus for detecting changes in the capacitance of an antenna caused by the approach of a person or object to the antenna, comprising in combination:

switching means operable to connect said antenna to a reference voltage source such that the antenna is charged to a fixed voltage relative to a reference body, current to voltage convertor means operable to discharge the antenna and generate a voltage proportional to the amount of charge stored on the antenna; said switching means operable to disconnect the antenna from the reference voltage and connect it to current to voltage convertor means, oscillator means operable to control said switching means whereby said antenna is connected to said reference voltage source and then connected to said current to voltage convertor means sequentially and repetitively; and comparator means operable to respond to small changes in the output voltage of the current to voltage convertor means resulting from a change in the capacitance of the antenna caused by the approach of a person or object to the antenna.

3. An apparatus as in claim 2 wherein said switching means is comprised of a pair of transistors connected such that when one transistor is turned on the antenna is electrically connected to the reference voltage source, and when the other transistor is on the antenna is electrically connected to current to voltage convertor means.

4. An apparatus as in claim 3 wherein said pair of transistors is comprised of one N-channel and one P-channel metal oxide semiconductor field effect transistor.

5. An apparatus as in claim 2 wherein said current to voltage convertor means is comprised of a resistor and a capacitor connected in parallel to each other such that the antenna is discharged through the resistor and capacitor.

6. An apparatus as in claim 2 wherein said current to voltage convertor means is comprised of a capacitor connected in parallel with a metal oxide semiconductor field effect transistor that functions as a voltage controlled resistor.

7. An apparatus as in claim 6 wherein the gate terminal of the metal oxide semiconductor field effect transistor is connected to the drain terminal through a resistor and capacitor connected as a low pass filter whereby the gate voltage increases until the current flowing through the transistor exactly equals the average discharge current from the antenna.

8. An apparatus as in claim 2 wherein said current to voltage convertor means is comprised of a capacitor in parallel with a bipolar transistor connected to function as a current sink.

9. An apparatus as in claim 8 wherein the collector voltage of said transistor is applied to the base of the transistor through a low pass filter and a source follower such that the collector current of the transistor is automatically adjusted to keep the collector voltage near a specified level irrespective of the size of the antenna.

10. An apparatus as in claim 2 wherein said current to voltage convertor means is isolated from the antenna by means of a current mirror.

11. An apparatus as in claim 10 wherein said current mirror is comprised of two bipolar transistors connected such that when the antenna discharge current flows through the collector of one transistor, an identical current is drawn from the current to voltage convertor means through the collector of the other transistor.

12. An apparatus as in claim 2 wherein said comparator means is AC coupled to the output of said current to voltage convertor means such that it will respond only to the relatively rapid changes caused by the approach of a person or object to the antenna.

* * * * *